United States Patent [19]

Ueno et al.

[11] 4,267,219

[45] May 12, 1981

[54] FLOCKED LAMINATES HAVING ADHESIVE CONTAINING HOT-MELT POLYMER PARTICLES

[75] Inventors: Hideo Ueno, Kawachinagano; Juiti Miyosi, Sakai, both of Japan

[73] Assignee: Takeda Chemical Industries, Ltd., Osaka, Japan

[21] Appl. No.: 76,082

[22] Filed: Sep. 17, 1979

[30] Foreign Application Priority Data

Oct. 2, 1978 [JP] Japan ..... 53-122165

[51] Int. Cl.[3] ..... B32B 33/00

[52] U.S. Cl. ..... 428/90; 428/95; 428/96; 428/97; 428/327; 428/334; 428/339; 428/349; 428/355

[58] Field of Search ..... 428/85, 88, 90, 95, 428/96, 97, 327, 334, 339, 349, 355

[56] References Cited

U.S. PATENT DOCUMENTS

| | | | |
|---|---|---|---|
| 2,688,577 | 9/1954 | Fischer | 428/88 |
| 4,142,929 | 3/1979 | Otomine | 428/90 |

*Primary Examiner*—Marion McCamish

*Attorney, Agent, or Firm*—Hubbell, Cohen, Stiefel & Gross

[57] ABSTRACT

A flocked laminate useful for number markings on baseball uniforms and appliqués on children's garments, bags, etc. The laminate has a layer of an adhesive composed of a polymer emulsion and a finely divided synthetic resin admixed with the polymer emulsion, having hotmelt adhering properties, and indentical or compatible with the synthetic resin providing a base layer. The laminate exhibits outstanding adhering properties and resistance to washing when placed on an article and heat-pressed.

11 Claims, 1 Drawing Figure

FLOCKED LAMINATES HAVING ADHESIVE CONTAINING HOT-MELT POLYMER PARTICLES

BACKGROUND OF THE INVENTION

1. Field of the Invention

This invention relates to flocked laminates which can be adhered to articles when placed thereon and heat-pressed and which exhibit outstanding adhering properties and resistance to washing when so applied. More particularly the invention relates to flocked laminates comprising a synthetic resin base layer, a layer of an adhesive prepared from a polymer emulsion and applied to the base layer and a flock layer formed on the adhesive layer, the adhesive incorporating a finely divided synthetic resin having hotmelt adhering properties and admixed with the polymer emulsion.

2. Brief Description of the Prior Art

Heretofore generally used as adhesives for the direct flocking process are acrylic emulsions which are predominantly of the self-cross-linking type or reactive type. For example, such acrylic emulsions are used as adhesives of the heat-press type in combination with a base layer of polyamide resin having low-melting point.

However, flocked laminates of such structure were not fully resistant to washing. While the flocked laminates of this invention are used mainly as number markings on baseball uniforms and appliques on children's garments, bags, etc., these articles must be washed frequently. Accordingly if the laminates have high resistance to washing in addition to the requirement of exhibiting good adhering properties when heat-pressed as against uniforms, the laminates will have a correspondingly higher commercial value, whereas the flocked laminates of this type heretofore known were not fully resistant to washing. Attempts have been made to overcome this problem. For instance, it has been proposed to add melamine resin to the acrylic emulsion to afford a fortified cross-linked structure [Rubber Digest (Tokyo), September, 1961, Vol. 13, No. 9, pp. 18–19]. The proposal nevertheless still fails to give satisfactory washing resistance. Furthermore improved washing resistance, if available, requires use of an increased amount of melamine resin which gives off the odor of formalin during use and provides too hard a hand.

SUMMARY OF THE INVENTION

To solve the foregoing problems, we have conducted intensive research and unexpectedly found that increased bond strength and improved washing resistance can be afforded by the use of an adhesive comprising a polymer emulsion and a finely divided synthetic resin admixed with the emulsion, the synthetic resin being identical or compatible with the synthetic resin used for the synthetic resin base layer having hotmelt adhering properties. The present invention has been accomplished based on this finding.

Thus the invention provides flocked laminates comprising a synthetic resin base layer having hotmelt adhering properties, a layer of an adhesive prepared from a polymer emulsion and applied to the base layer and a flock layer formed on the adhesive layer, the adhesive incorporating a finely divided synthetic resin as admixed with the polymer emulsion in an amount of about 0.1 to about 50 parts by weight per 100 parts by weight of the solids of the polymer emulsion, the finely divided synthetic resin having hotmelt adhering porperties and being identical or compatible with the synthetic resin used for the base layer.

DESCRIPTION OF THE PREFERRED EMBODIMENTS

Figure 1:
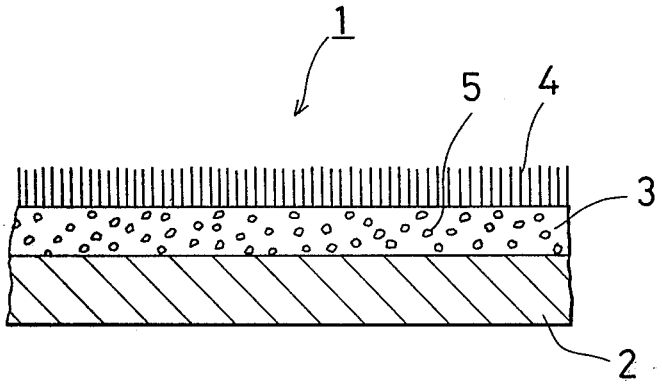
FIG. 1 is a fragmentary enlarged view in section showing a flocked laminate according to this invention.

FIG. 1 shows a flocked laminate 1 comprising a synthetic resin base layer 2 having hotmelt adhering properties, a layer 3 of an adhesive coating the base layer and incorporating particles of synthetic resin 5, and a flock layer 4 formed over the adhesive layer.

The synthetic resin to be used for the base layer in the form of a film in this invention is a resin which can be adhered to cloth, leather, etc. when heat-pressed. Examples of useful synthetic resins are those generally used for hotmelt adhesives, such as vinyl resins typical of which is ethylene-vinyl acetate copolymer, polyolefin resins typical of which is polyethylene resin, polyester resins, polyamide resins, etc.

Especially preferable are copolymerized polyamide resins composed of at least three monomers and recently developed for use in hotmelt adhesives for fibers. Such polyamide resins are heat-sealable at low temperatures and have resistance to washing. More specific examples of useful copolymerized polyamide resins are polyamide copolymers consisting essentially of lauric lactam or 11-aminoundecanoic acid, such as nylon 6/66/12 (Published Examined Japanese Patent Application No. 22240/1970), nylon 6/610/12 (Published Examined Japanese Patent Application No. 29876/1975), nylon 6/612/12 (Published Unexamined Japanese Patent Application No. 39766/1973), nylon 6/66/69/12 (Published Unexamined Japanese Patent Application No. 35291/1977), nylon 6/66/11/12 (Published Unexamined Japanese Patent Application No. 35290/1975), etc.

These synthetic resins having hotmelt adhering properties generally have a melting point of about 80° to about 160° C., as determined by a differential scanning calorimeter (DSC) at a maximum peak value of heat absorption when the resin was heated at a rate of 16° C./min.

Such synthetic resins are used for the synthetic base resin layer of this invention in the form of a film 30 to 1000$\mu$, preferably 50 to 200$\mu$, in thickness.

The synthetic resin base layer having hotmelt adhering properties may be in the form of a laminate of two kinds of resins, such as ethylene-vinyl acetate copolymer resin and a polyamide resin in combination.

The finely divided synthetic resin to be admixed with a polymer emulsion and useful for giving improved washing resistance is a synthetic resin having hotmelt adhering properties and identical or compatible with the synthetic resin to be used for the base layer. The term "identical" as herein used refers to exact identity in respect of the primary structure, mean molecular weight, melting point, viscosity, etc. of the hight-molecular-weight molecules constituting the resin. The term "compatible" means that the solubility parameter of the synthetic resin to be admixed with the polymer emulsion is in the range of the solubility parameter of the base layer resin ±15% thereof.

In this regard, the solubility parameter can be calculated e.g., by the formula $S.P. = d\Sigma G/M$ d : density $\Sigma G$ : = total sum for molecular attraction constants of atoms and groups of atoms M : molecular weight of building block In case of a copolymer, its solubility parameter is determined by calculating S.P. value of each of components of copolymer by the above formula and multifying the calculated S.P. value by molar fraction.

The finely divided synthetic resin, when not identical with the base layer resin, preferably has a melting point in the range of 80° to 160° C. and close to the melting point of the base layer resin to the greatest possible extent (not more than 30° C. above or below the latter). For example, when one of the aforementioned polyamide resins is used for the base layer, it is most suitable to use a finely divided polyamide resin.

The finely divided synthetic resin is used in an amount of about 0.1 to about 50 parts by weight, preferably about 1 to about 20 parts by weight, per 100 parts by weight of the solids of the polymer emulsion.

The finely divided synthetic resin is usable when less than about 150μ in mean particle size. Although not particularly limited in particle size from the viewpoint of adhering properties, the resin is satisfactorily usable when having particle sizes not exceeding the thickness of the adhesive layer.

Any of various polymer emulsions is usable as the base material of the adhesive of this invention. Examples of useful polymer emulsions are natural rubber latex, latexes of synthetic rubbers such as nitrilebutadiene rubber, styrenebutadiene rubber, chloroprene rubber, etc., and emulsions of synthetic resins such as polyacrylate, copolymer resins containing as a copolymer component acrylic acid or methacrylic acid or an ester of the acid, vinyl chloride resin, vinylidene chloride resin, vinyl acetate resin, ethylene-vinyl acetate copolymer resin, epoxy resin, polyurethane resin, etc. These emulsions are of course usable as modified in the usual manner.

Such polymer emulsions are usable singly or in admixture.

When desired, the polymer emulsions may further incorporate a tackifier, pigment, cross-linking agent (melamine resin, epoxy resin, block copolymer of isocyanate, or the like), or a catalyst for cross-linking, etc.

The adhesive incorporating the finely divided synthetic resin with hotmelt adhering properties in used for flocking in an amount which is dependent on the length of monofilaments for forming the flock layer, the type of base material and the thickness of the flocked laminate. The amount is suitably 120 to 160 g/m$^2$ for use with monofilaments up to 1 mm in length, 160 to 230 g/m$^2$ for 1- to 2-mm long monofilaments, or 250 to 300 g/m$^2$ for longer monofilaments.

According to this invention, a dye or pigment is added to the synthetic resin base layer having hotmelt adhering properties to give the layer a hiding power to obscure the article or clothing to which the flocked laminate is to be applied, thus rendering the laminate unaffected by the color of the article. When the synthetic resin base layer comprises two films of different synthetic resins, the dye or pigment is added to one or both of the component films.

When the synthetic resin base layer is composed of a hotmelt adhesive of nylon resin such as nylon 6/66/12, a hiding power may be imparted to the base layer, for example, by incorporating into the nylon copolymer resin 1 to 10 parts by weight of ethylene-vinyl acetate copolymer resin containing 10 to 30% by weight of vinyl acetate and 3 to 15 parts by weight of finely divided titanium oxide having a high hiding power, per 100 parts by weight of the nylon resin.

Other dyes or pigments having a high hiding power are black (e.g. Toyo Dry Color TN-0643), red (e.g. Toyo Dye Color TN-4273), blue (e.g. Toyo Dry color TN-7268), etc.

It is preferable to color the synthetic resin base layer with a dye or pigment of substantially same color as the flock of monofilaments to be used to thereby permit the flock to exhibit its color free of any change. This also serves to obscure a flaw (lack of filaments) in the flock layer. With use of such a dye or pigment, the base layer and the flock will look identical or alike.

The adhesive layer to be formed on the synthetic resin base layer can also be colored with a dye or pigment.

The flock layer to be formed directly over the adhesive layer in this invention is prepared from usual monofilaments of acrylic, nylon or like resin cut in the form of a bundle and dyed. The adhesive layer is directly flocked generally electrostatically (by the electrodeposition or electroflocking process).

The present invention will be described below with reference to examples, in which the layers are referred to by the same numerals as used in FIG. 1.

EXAMPLE 1

A film (100μ in thickness) of nylon 6/66/12 (copolymerization ratio 30:30:40, m.p. 106° C.) serving as a synthetic resin base layer 2 was coated (to a dry thickness of about 100μ) with a methacrylic acid-modified, ethyl acrylate-butyl acrylate copolymer emulsion (solids concentration 46%, containing 5 parts by weight of methylolmelamine resin per 100 parts by weight of the solids of the emulsion and made viscous to about 1000 cps with ammonia water) incorporating 3 parts by weight of particles (60μ in mean size) of the same nylon 6/66/12 as above. The coating was directly electrostatically flocked with monofilaments of rayon (7.5 denier in thickness, 0.5 mm in length). The flocked sheet was thereafter baked at a temperature of 90° C. which was lower than the melting point of the polyamide resin film to obtain a flocked laminate 1.

In this stage, the acrylic emulsion had not been fully bonded to the polyamide film since the polyamide resin in the emulsion still remained particulate.

The flocked laminate 1 was then cut into pieces of desired shape. The pieces were placed on articles of clothing such as baseball uniforms and T-shirts and heat-pressed with an iron at a temperature of 150° C. for 10 seconds to adhere the flocked pieces to the articles.

The flocked laminate adhered to the uniforms and T-shirts as finished product, had outstanding resistance to washing.

EXAMPLE 2

A film (100μ in thickness) of nylon 6/66/12 (copolymerization ratio 30:30:40, m.p. 106° C.) the same as one used above and serving as a synthetic resin base layer 2 was coated to a thickness of about 150μ with an adhesive which was prepared from the same acrylic emulsion as above and particles (100μ in mean size) of nylon 6/612/12 (copolymerization ratio 30:30:40, m.p. 106°

C.) admixed with the emulsion in an amount of 5 parts by weight per 100 parts by weight of the solids of the emulsion. The same procedure as above was thereafter repeated to obtain a similar finished product, which was also found to have outstanding resistance to washing.

EXAMPLE 3

The same acrylic emulsion as used in Example 1 and NBR latex ("CROSLENE NA-10," product of Takeda Chemical Industries, Ltd., solid concentration 40%) were mixed together in a solid ratio of 50:50. Five parts by weight of methylolmelamine resin and 10 parts by weight of particles (80μ in mean particle size) of nylon 6/69/11/12 (copolymerization ratio 25:25:25:25, m.p. 85° C.) were admixed with the mixture per 100 parts by weight of solids thereof. The resulting mixture was applied to a film (150μ in thickness) of nylon 6/66/12 (copolymerization ratio 30:30:40, m.p. 106° C.) to a thickness of 100μ when dried. The coated film was electrostatically flocked in the same manner as in Example 1. The flocked sheet was cured for 7 minutes at a temperature of 90° C. which was lower than the melting point of the copolymer polyamide resin film. Pieces of the flocked laminate then were heat-pressed against sheets of cotton cloth with an iron (surface temperature 160° C.) for 30 seconds for bonding to obtain test pieces. Test pieces were tested for wet abrasion resistance on a wet rubbing tester of the Gakushin type. Other test pieces were rubbed by hand in hot water at 70° to 80° C. for 7 minutes for the evaluation of washing resistance. For comparison, test pieces were prepared in the same manner as above except that the adhesive composition was free from the polyamide copolymer resin, and the test pieces were tested similarly. The results are given below.

| | Wet abrasion resistance | Washing resistance |
|---|---|---|
| Example of the invention | Good | Excellent |
| Comparison example | Poor | Poor |

EXAMPLE 4

An adhesive was prepared by adding 30 parts by weight of particles (50μ in mean size) of nylon 6/66/12 (copolymerization ratio 30:30:40, melting point 106° C.) to an ethylene-vinyl acetate copolymer emulsion (modified with acrylic acid, containing 11.2% of ethylene, solids concentration 52%) per 100 parts by weight of the solids of the emulsion. A film (100μ in thickness) of the same composition as the above nylon copolymer resin was coated with the adhesive to a thickness of 150μ, and the coating was electrostatically flocked in the same manner as in Example 1. The flocked laminate obtained was thermally bonded to cloth with an iron. The product had higher resistance to washing than a similar product prepared without using the particles.

Such outstanding resistance to washing appears attributable to the presence of the finely divided polyamide resin which is identical or compatible with the base layer resin and admixed with the adhesive of acrylic emulsion used for flocking, since when the base layer is heat-pressed at 150° C. and melted, the polyamide resin particles also melt at the same time, thus acting on the base layer as an anchoring agent under the pressure.

What we claim is:

1. A flocked laminate comprising a synthetic resin base layer having hotmelt adhering properties, an adhesive layer applied to said base layer, said adhesive layer prepared from a polymer emulsion and admixed with a finely divided synthetic resin compatible or identical with said base layer synthetic resin, in an amount of about 0.1 to about 50 parts by weight per 100 parts by weight of the solids of the polymer emulsion; and a flock layer formed on the adhesive layer.

2. A flocked laminate as defined in claim 1 wherein the synthetic resin of the base layer is a vinyl resin, polyolefin resin, polyester resin or polyamide resin.

3. A flocked laminate as defined in claim 2 wherein the synthetic resin of the base layer is a copolymerized polyamide resin having a melting point of about 80° to about 160° C. and composed of at least three monomers.

4. A flocked laminate as defined in claim 3 wherein the copolymerized polyamide resin is a polyamide copolymer consisting essentially of a lauric lactam or 11-aminoundecanoic acid.

5. A flocked laminate as defined in claim 3 wherein the copolymerized polyamide resin is nylon 6/66/12, nylon 6/610/12, nylon 6/612/12, nylon 6/66/69/12 or nylon 6/66/11/12.

6. A flocked laminate as defined in claim 1 wherein the synthetic resin admixed with the polymer emulsion is identical with the base layer synthetic resin.

7. A flocked laminate as defined in claim 1 wherein the synthetic resin admixed with the polymer emulsion has a solubility parameter in the range of the solubility parameter of the base layer synthetic resin ±15% thereof.

8. A flocked laminate as defined in claim 1 wherein the finely divided synthetic resin is admixed with the polymer emulsion in an amount of about 1 to about 20 parts by weight per 100 parts by weight of the solids of the emulsion.

9. A flocked laminate as defined in claim 1 wherein the finely divided synthetic resin admixed with the polymer emulsion is less than about 150μ in mean particle size.

10. A flocked laminate as defined in claim 1 wherein the polymer emulsion is natural rubber latex, a latex of nitrile-butadiene rubber, styrene-butadiene rubber or chloroprene rubber, or an emulsion of polyacrylate, copolymer resin containing as a copolymer component acrylic acid or methacrylic acid or an ester of the acid, vinyl chloride resin, vinylidene chloride resin, vinyl acetate resin, ethylene-vinyl acetate copolymer resin, epoxy resin or polyurethane resin.

11. A flocked laminate as defined in claim 1 wherein the synthetic resin base layer has a thickness of 30 to 1000μ.

* * * * *

UNITED STATES PATENT AND TRADEMARK OFFICE

CERTIFICATE OF CORRECTION

PATENT NO. : 4,267,219

DATED : May 12, 1981

INVENTOR(S) : HIDEO UENO et al.

It is certified that error appears in the above—identified patent and that said Letters Patent is hereby corrected as shown below:

On the cover page the Assignee should read:

-- Takeda Chemical Industries, Ltd., Osaka, Japan;

Kongo Flocking Corporation, Ltd., Kawachinagano, Japan

Japan and Daicel Ltd., Sakai, Japan. --.

Signed and Sealed this

*Twelfth* Day of *January 1982*

[SEAL]

*Attest:*

GERALD J. MOSSINGHOFF

*Attesting Officer*

*Commissioner of Patents and Trademarks*